US006775953B2

(12) United States Patent
Burken et al.

(10) Patent No.: US 6,775,953 B2
(45) Date of Patent: Aug. 17, 2004

(54) SIMPLIFIED WALL PANEL

(75) Inventors: David J. Burken, Blue Grass, IA (US); Matthew C. Brown, Wilton, IA (US); Jeffrey E. Tjebkes, Muscatine, IA (US); Chad C. Lolling, Wapello, IA (US); Peter A. Simmons, Wapello, IA (US); Tim B. Wilson, Muscatine, IA (US); Gordon K. Hartman, Atalissa, IA (US); Brian D. Meyer, Muscatine, IA (US); Darren P. Williams, Muscatine, IA (US); Thomas W. Garrett, Muscatine, IA (US); Michael J. Frantz, Muscatine, IA (US); Joseph A. Miller, Muscatine, IA (US); Matthew R. Hanley, Davenport, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/160,602

(22) Filed: May 31, 2002

(65) Prior Publication Data

US 2003/0221384 A1 Dec. 4, 2003

(51) Int. Cl.[7] ..... E04C 2/34

(52) U.S. Cl. ..... 52/481.2; 52/476; 52/489.1; 52/238.1; 52/745.09

(58) Field of Search ..... 52/476, 481.2, 52/489.1, 489.2, 762, 239, 242, 243, 238.1, 36.1, 745.09, 745.1

(56) References Cited

U.S. PATENT DOCUMENTS

| | | | | |
|---|---|---|---|---|
| 4,035,972 | A | | 7/1977 | Timmons |
| 4,067,165 | A | | 1/1978 | Timmons |
| 4,120,124 | A | | 10/1978 | Temple et al. |
| 4,269,005 | A | | 5/1981 | Timmons |
| 4,423,573 | A | * | 1/1984 | Omholt et al. ..... 52/145 |
| 4,477,128 | A | | 10/1984 | Hasbrouck |
| 4,516,619 | A | | 5/1985 | Hasbrouck |
| D303,458 | S | | 9/1989 | Zapf |
| D305,582 | S | | 1/1990 | Zapf |
| 4,971,281 | A | | 11/1990 | Steinbeck |
| 5,044,135 | A | | 9/1991 | Kroon et al. |
| 5,069,263 | A | | 12/1991 | Edwards |
| D323,251 | S | | 1/1992 | Zapf |
| 5,117,599 | A | | 6/1992 | Voss |
| D330,295 | S | | 10/1992 | Zapf |
| D330,641 | S | | 11/1992 | Zapf |
| D330,642 | S | | 11/1992 | Zapf |
| D330,643 | S | | 11/1992 | Zapf |
| 5,172,530 | A | | 12/1992 | Fishel et al. |
| 5,184,441 | A | | 2/1993 | Balfanz |
| 5,218,799 | A | | 6/1993 | Appino |

(List continued on next page.)

*Primary Examiner*—Jennifer Thissell
(74) *Attorney, Agent, or Firm*—Joseph H. Golant; Jones Day

(57) ABSTRACT

A number of wall panel apparatuses are disclosed. In one embodiment the wall panel apparatus includes a rectangular frame, two oppositely disposed metal tiles, each tile having a number of attachment and mounting clips whereby mounting of the tiles to opposite sides of the rectangular frame is easily accomplished by locating mounting clips attached to the lower edge portions of the tiles to a bottom frame member and pivoting the upper portion of the tiles so that the attachment clips which are resilient snap into place. A glass wall panel apparatus includes the same rectangular frame, however, top and bottom channels cover the top and bottom frame members of the rectangular frame, each of the channels having hook portions for engaging the top and bottom edges of the glass panes. Also included are side shroud channels and tensioning screws to adjust the channels in relation to the glass panes.

13 Claims, 11 Drawing Sheets

U.S. PATENT DOCUMENTS 5,488,808 A 2/1996 Cahill et al.
5,743,055 A 4/1998 Conner et al.
6,012,258 A * 1/2000 Brown et al. ..... 52/239
6,047,509 A * 4/2000 Savoie ..... 52/281
6,330,773 B1 12/2001 MacDonald et al.
6,339,907 B1 1/2002 Dame et al.
6,349,516 B1 2/2002 Powell et al.
6,397,533 B1 * 6/2002 Hornberger et al. ..... 52/239
6,601,349 B1 * 8/2003 Corden ..... 52/36.5

* cited by examiner

SIMPLIFIED WALL PANEL

BACKGROUND OF THE INVENTION

1. Field of the Invention

The present invention relates to a wall panel and more particularly to a simplified base wall panel and stacking wall panel that is strong, versatile and easy to assemble.

2. Description of the Related Art

Wall panel systems typically are used to form office work spaces that are efficient, generally inexpensive when compared to fixed wall offices, and adjustable. Examples of such systems are shown in recently issued U.S. Pat. Nos. 6,339,907; 6,330,773 and 6,349,516, and older U.S. Pat. Nos. 5,743,055 and 4,971,281. These patents are incorporated here by reference as if fully set forth. Existing wall panel systems are also shown in catalogs, such as in BPI's catalog for its PARALLEL brand system and in Allsteel's advertisement for its CONCENSYS brand system. These marketing materials are also incorporated here by reference as if fully set forth.

Even though wall panels have been in existence for many years, wall panels such as those shown in the above mentioned patents can be relatively expensive, difficult to assemble, complicated and not very versatile.

BRIEF SUMMARY OF THE INVENTION

The difficulties encountered with previous systems have been overcome by the present invention. What is described here is a wall panel apparatus comprising a rectangular frame of tubular metal including horizontally disposed top and bottom frame members and two vertically disposed side frame members, wherein the bottom frame member includes at least screw receiving openings through the tubular metal, two tiles connected to the rectangular frame and fasteners for connecting the tiles to the rectangular frame.

There are a number of advantages, features and objects achieved with the present invention which are believed not to be available in earlier related systems. For example, several advantages are that the present invention provides an improved wall panel which is simply constructed, reliable and relatively inexpensive. The present invention also provides for a very strong wall panel which is also durable. Further advantages are that the wall panel described herein is versatile and comprises relatively few parts. Yet another object is that a stacking wall panel can easily and quickly be attached to a base wall panel. Still another feature of the wall panel is that it is aesthetically pleasing.

A more complete understanding of the present invention and other objects, advantages and features thereof will be gained from a consideration of the following description of preferred embodiments read in conjunction with the accompanying drawing figures provided herein. The preferred embodiments represent examples of the invention which are described here in compliance with Title 35 U.S.C. section 112 (first paragraph), but the invention itself is defined by the attached claims.

DETAILED DESCRIPTION OF PREFERRED EMBODIMENTS OF THE INVENTION

Figure 1:
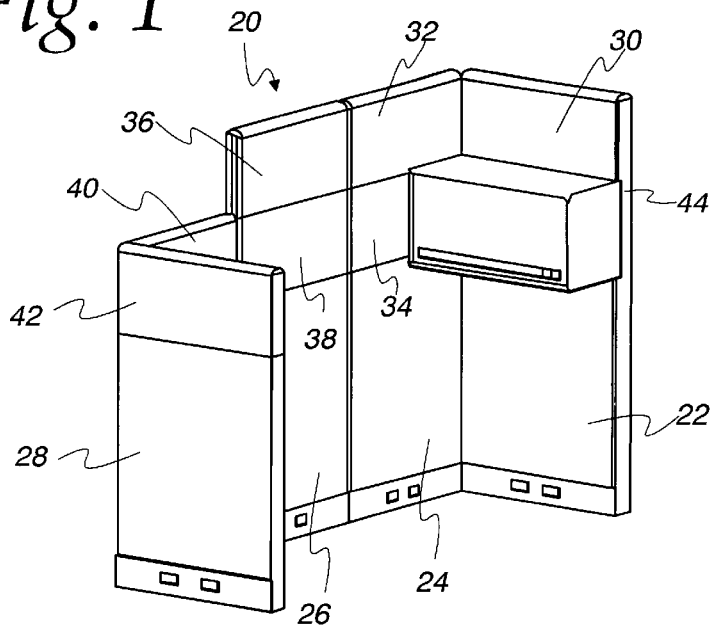
FIG. 1 is an isometric view of a wall panel system.

While the present invention is open to various modifications and alternative constructions, the preferred embodiments shown in the various figures of the drawing will be described herein in detail. It is understood, however, that there is no intention to limit the invention to the particular embodiments, forms or examples disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

There is illustrated in FIG. 1 an example of a wall panel system 20 including a series of base wall panels 22, 24, 26, 28 as well as a series of smaller stacking panels 30, 32, 34, 36, 38, 40, 42, 44. As can seen, the stacking panels are smaller panels which are positioned and attached to the tops of the base wall panels or to the tops of other stacking panels. The stacking wall panels may be retrofitted to an existing wall panel system or the stacking wall panels may be designed into the wall panel system for aesthetic or other reasons. A cabinet 46 may be hung on the stacking wall panel 44 as shown or on a base wall panel. Other items, such as shelves, trays, a desk and a table may also be hung from the wall panel system.

Referring now to FIGS. 2, 3, 4 and 5, there is illustrated a preferred embodiment of a stacking wall panel 50 which includes a rectangular welded frame 52 constructed of tubular steel. The rectangular frame includes a horizontally disposed top frame member 54, a horizontally disposed bottom frame member 56 and two vertically disposed side frame members 58, 60. The bottom frame member 56 includes aligned openings 62, 64, 66, 68 for receiving threaded fasteners, such as screws 70, 72. The bottom frame member also includes three elongated slots 74, 76, 78. The top frame includes three clip notches 80, 82, 84 along its bottom side. Each side frame member includes a series of notches 85 for mounting brackets to mount or hang cabinets, shelves and other usual items.

Figure 7:
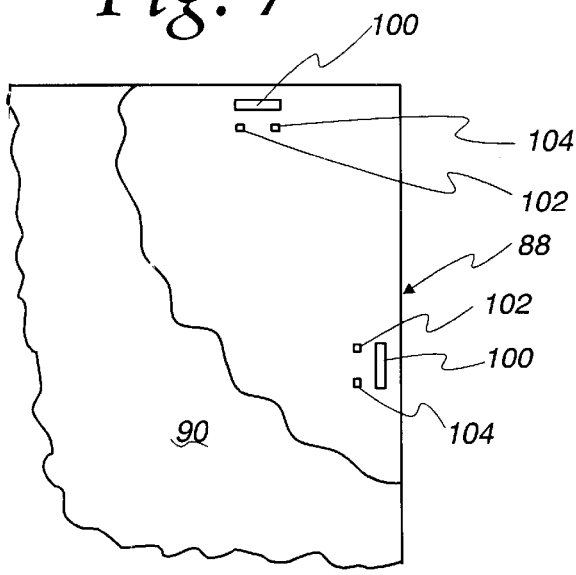
FIG. 7 is a partial front view, partially broken-away of the tile.
Figure 6:
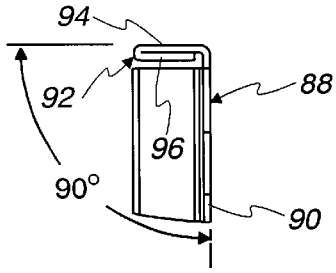
FIG. 6 is an enlarged sectional view of a wall panel tile taken along line 6—6 of FIG. 2.

The wall panel also includes two panel members or tiles 86, 88, each of which is formed from about 20-gauge steel having a large, generally flat middle portion 90, FIGS. 6 and 7, and a double bent peripheral portion 92. As shown in FIG. 6, the peripheral portion includes a first leg 94 which is bent ninety degrees from the middle portion 90 and a second leg 96 which is bent one hundred eighty degrees from the first leg 94. This provides for a stiff and strong tile.

The tiles also include a series of openings, such as those shown in FIG. 7, which openings are clustered in groups of three, each group including a slot 100 and two small rectangular openings 102, 104. As will be explained, each of these openings are especially formed to receive attachment clips. A group of openings exist at each clip location illustrated in FIG. 2.

Referring back to FIG. 2, each tile has fasteners, including three attachment clips 110, 112, 114 mounted to the tile upper portions 116, two side attachment clips 118, 120 mounted to the tile side portions 122, 124 and three mounting clips 126, 128, 130 mounted to the tile bottom portions 132.

Referring now to FIGS. 8, 9, 10 and 11, it maybe seen that the attachment and mounting clips are simply made. Each clip has a generally U-shape profile with a base 134, 136 and two legs 138, 140, 142, 144. Formed from one of the legs 140, FIGS. 8 and 9, of the attachment clip 110 is an extending tab 150 having a bump or protrusion 152 formed for engaging the rectangular frame and in particular, one of the three notches 80, 82, 84, FIG. 4, in the under side of the top frame member 54. The attachment clips are made of steel and are about 0.025 inches thick. This allows the tab to be resilient. The attachment clips also have been formed to include two offset fingers 154, 156 for the purpose of forming an interference fit with the two small rectangular openings 102, 104, FIG. 7, in the tile. The attachment clips are relatively small having a height dimension of approximately 0.90 inches, a width dimension of about 1 inch and a tab extension of about 0.7 inches.

Figure 10:
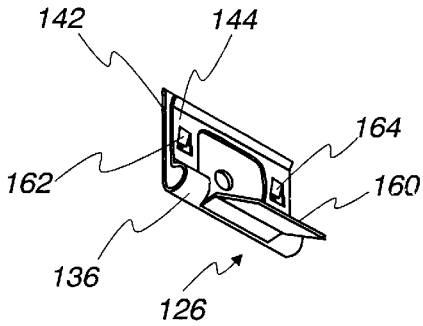
FIG. 10 is a front isometric view of a mounting clip.
Figure 11:
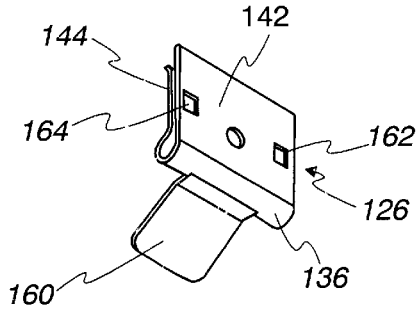
FIG. 11 is a rear isometric view of the mounting clip illustrated in FIG. 10.

The mounting tabs shown in FIGS. 10 and 11 are very similar to the attachment tabs in that each is formed of steel with a thickness of about 0.025 inches and includes a generally U-shaped profile with the base 136 and two legs 142, 144. Formed from one of the legs is an extending tab 160 and two offset fingers 162, 164. The tabs of the mounting clips extend downwardly without a bump or protrusion.

Referring back to FIG. 2, the tiles are mounted to opposite sides of the rectangular frame by the mounting clips 126, 128, 130 inserted into the slots 74, 76, 78 in the bottom frame member 56 followed by a pivoting motion of the upper portion 116 of the tile so that the attachment clips 110, 112, 114 engage and fasten to the top frame member 54. The resilient or springy tabs of the attachment clips are pivoted by the top frame member until the protrusions align with the notches 80, 82, 84 allowing the tabs to spring back into an interference fit with the top frame member. The side attachment clips also are distorted when engaging the side frame members 58, 60. However, there may not be recesses or notches formed in the side frame members so that engagement is by friction fit between the clip tabs and an inner frame wall, such as the inner wall 166 of the side frame member 60.

Figure 2:
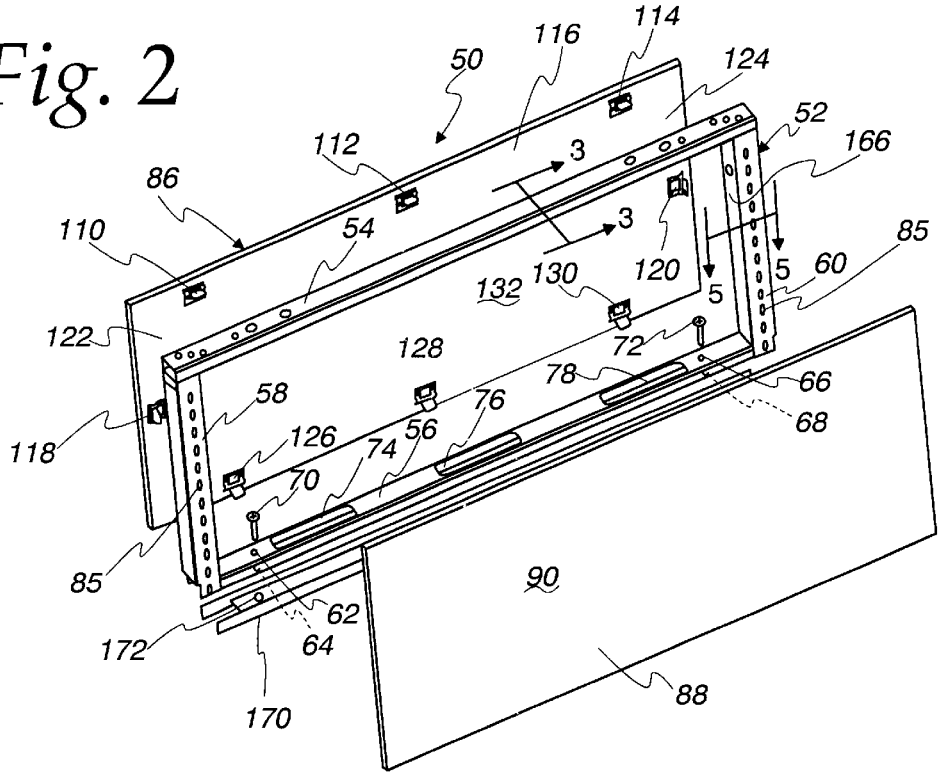
FIG. 2 is an exploded isometric view of a wall panel.
Figure 3:
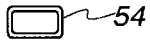
FIG. 3 is a sectional view taken along line 3—3 of FIG. 2.
Figure 4:
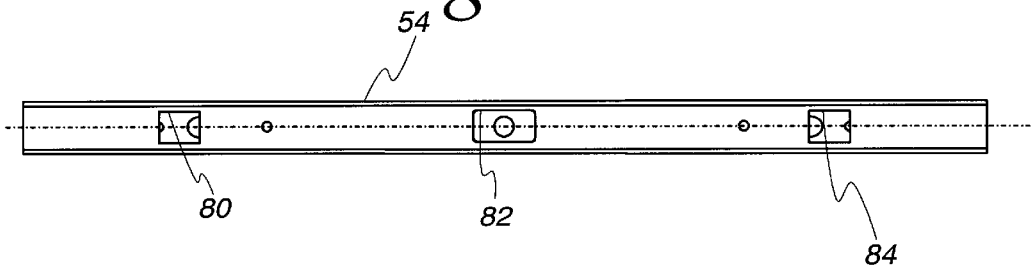
FIG. 4 is an enlarged bottom view of a top frame member.
Figure 5:
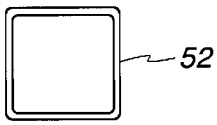
FIG. 5 is an enlarged sectional view taken along line 5—5 of FIG. 2.
Figure 12:
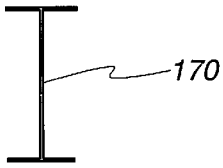
FIG. 12 is an enlarged sectional view of a light blocking strip taken along line 12—12 of FIG. 2 and rotated 90 degrees.

Located beneath the bottom frame member of the wall panel 50, FIG. 2, is an H-shaped light blocking strip 170, FIGS. 2 and 12, formed of any convenient material, such as PVC. The strip includes an opening 172 to align with the fastener openings 62, 64 in the bottom frame member. The embodiment of FIG. 2 illustrates a stacking wall panel. Hence, the screw fasteners 70, 72 engage the bottom frame member, pass through the opening in the light blocking strip and engage a top tube frame member 174, FIG. 13, of a base wall panel 176 as will be explained below. It is to be understood that generally the same construction can be used for a base wall panel if desired as described above and as will be described below.

Figure 14:
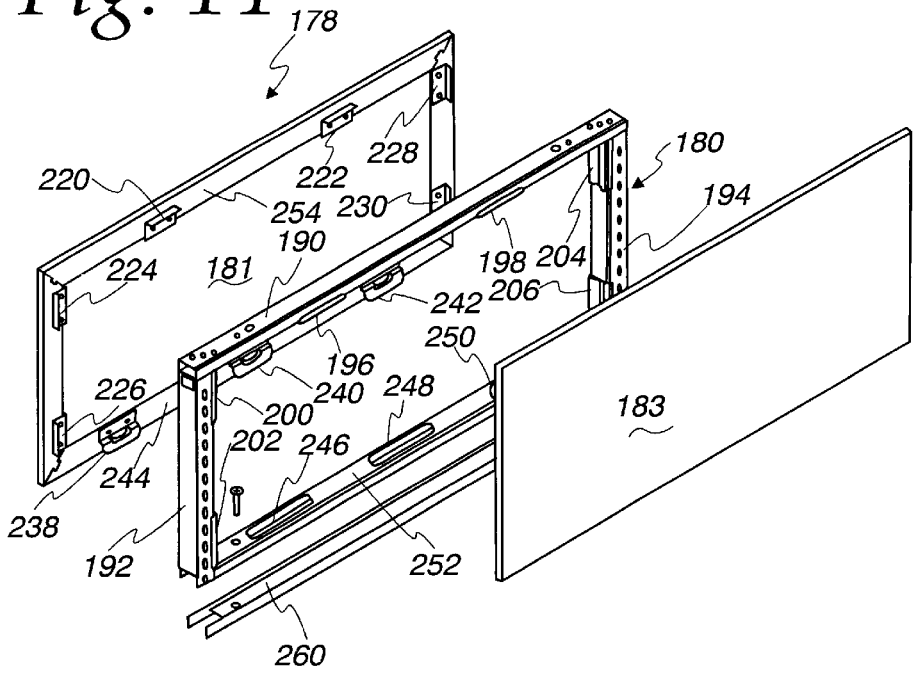
FIG. 14 is an exploded isometric view of another wall panel.
Figure 15:
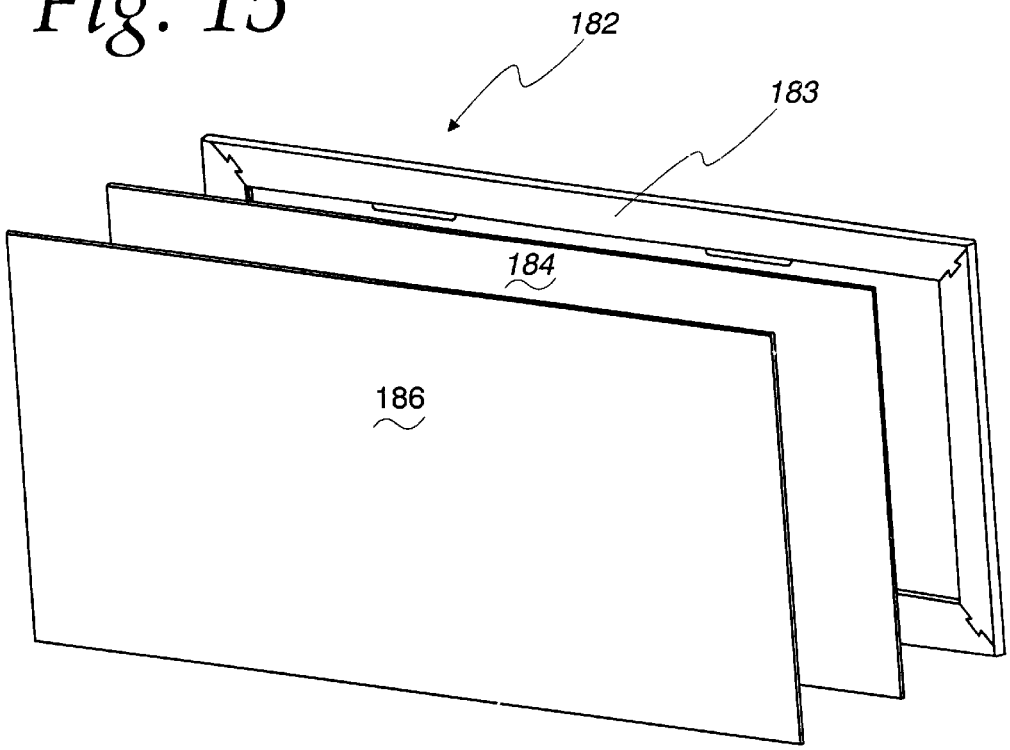
FIG. 15 is a partially exploded isometric view of another tile.

Referring now to FIG. 14, there is illustrated another embodiment of a stacking wall panel 178 having a rectangular frame 180 of tubular steel constructed in the same manner as the rectangular frame shown in FIG. 2. Each wall tile 181, 182 is formed of a PVC frame 183, FIG. 15, to which is adhered a hardboard or steel panel 184 and thereafter a fiberglass panel 186.

Figure 16:
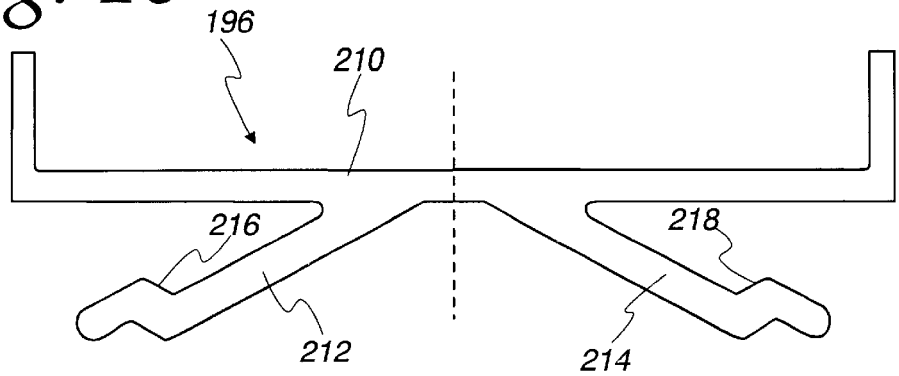
FIG. 16 is an enlarged end view of a female connector shown in FIG. 14.
Figure 17:
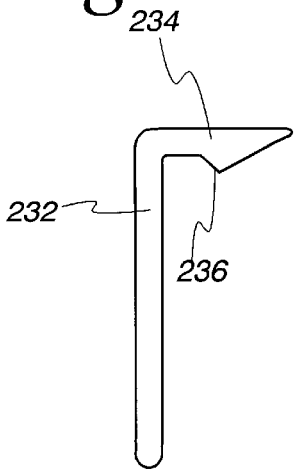
FIG. 17 is an enlarged end view of a male connector shown in FIG. 14.
Figure 18:
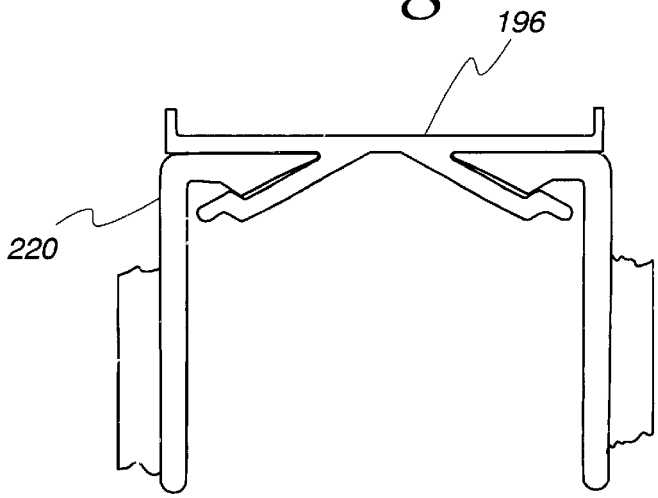
FIG. 18 is a scaled down end view illustrating the female connector and the male connector of FIGS. 16 and 17, respectively, fully engaged.
Figure 19:
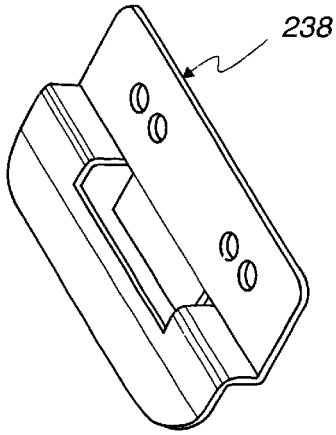
FIG. 19 is an isometric view of a mounting bracket.

Connected to side and top and side frame members 190, 192, 194, FIG. 14, are female connector clips 196, 198, 200, 202, 204, 206. Each female connector clip exemplified by the clip 196 includes a base portion 210, FIG. 16, and two arms 212, 214 forming a V-shape in section where each arm includes a shoulder 216, 218. Attached to the tiles are a series of male connector clips 220, 222, 224, 226, 228, 230, FIG. 14, which are each generally L-shaped having a long arm 232, FIG. 17, and a short arm 234. The short arm includes a shoulder 236. When a tile is mounted to the rectangular frame, arms 234, 235, FIG. 18, of the male connector clips snap into opposite sides of the female connector clip 196 between the arms 212, 214 and the base 210 so that there is an interference fit created between the shoulders of the male connector clips and the shoulders of the arms of the female connector clip. Bottom clips or brackets 238, 240, 242, FIG. 14, are attached along the bottom portion 244 of the tile 181 and are received by the three slots 246, 248, 250 in the bottom frame member 252. Engagement of a tile to the rectangular frame is similar to that described for the embodiment shown in FIG. 2. The mounting brackets are located within the slots of the bottom frame member and an upper portion 254 of the tile is pivoted to allow the male connector clips on the tile to be engaged with the female connector clips connected to the frame members. The bracket 238 is shown in more detail in FIG. 19.

As with the FIG. 2 embodiment, the FIG. 14 embodiment also includes a light blocking strip 260 when the embodiment is used as a stacking wall panel.

Figure 20:
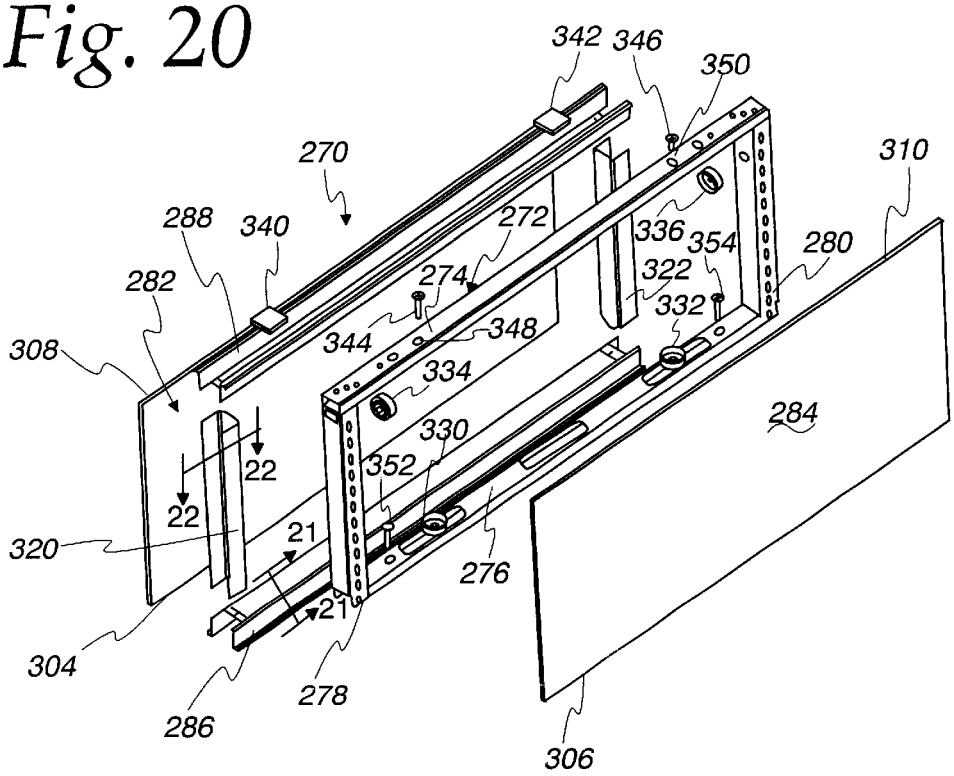
FIG. 20 is an exploded isometric view of a glass wall panel.

Referring now to FIG. 20, there is shown yet another preferred embodiment, this time of a glass stacking wall panel 270. A rectangular frame 272 is essentially identical to the frames 52 and 180 of the FIGS. 2 and 14 embodiments and include a top frame member 274, a bottom frame member 276 and two side frame members 278, 280. Instead of having an opaque panel with fasteners on each side of the frame, the embodiment of FIG. 20 has two panes of glass 282, 284 and fasteners in the form of a bottom channel 286 and a top channel 288. Each channel includes a base portion 290, FIG. 21, and two arm portions 292, 294. At the extended ends of each of the arm portions, there is formed a hook portion 296, 298. The hook portion may be considered a small channel to either side of the main channel. As shown, the bottom and top channels 286, 288 extend in length to cover the bottom and top frame members, respectively. The top and bottom channels may be made out of an aluminum alloy or steel having a thickness of approximately 0.042 inches. The width of the channels may be approximately 1.5 inches with a height of approximately 1.185 inches. Each hook portion has a width of about 0.254 inches and a tail 300, 302 of each hook portion extends about 0.175 inches and at about a three degree slant from a vertical plane. As may now be appreciated, bottom edges 304, 306 of the glass panes 282, 284 are received by the hook portions of the bottom channel and upper edges 308, 310 of the glass panes are received by the hook portions of the top channel to secure the glass panes to the frame.

Figure 22:
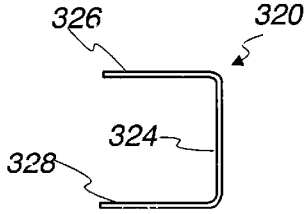
FIG. 22 is an enlarged sectional view of a shroud channel taken along line 22—22 of FIG. 20.

Vertical shroud channels 320, 322, FIGS. 20 and 22, generally U-shaped, having a base 324 and two arms 326, 328 are placed to cover the side frame members 278, 280. Bottom and side insert spacers 330, 332, 334, 336, are used to separate the bottom channel 286 from the bottom frame member 276 and the shroud channels 320, 322 from the side frame members 278, 280, respectively. Two pads 340, 342 are provided to separate the top channel 288 from the top frame member 274. The insert spacers and pads may be made of any suitable material, such as nylon. Tensioning screws 344, 346 may be placed within fastener openings 348, 350 in the top frame member so as to adjust the top channel to ensure a secure mounting of the glass panels. Attachment screw fasteners 352, 254 are provided to attach the stacking wall panel 270 to a base wall panel. It is to be noted that the same elements may be used to form a glass base wall panel with slight changes as will be described below.

Figure 21:
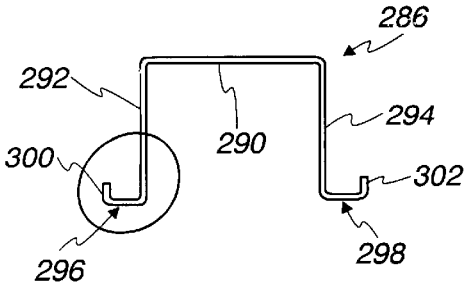
FIG. 21 is an enlarged sectional view of a channel taken along line 21—21 of FIG. 20.
Figure 23:
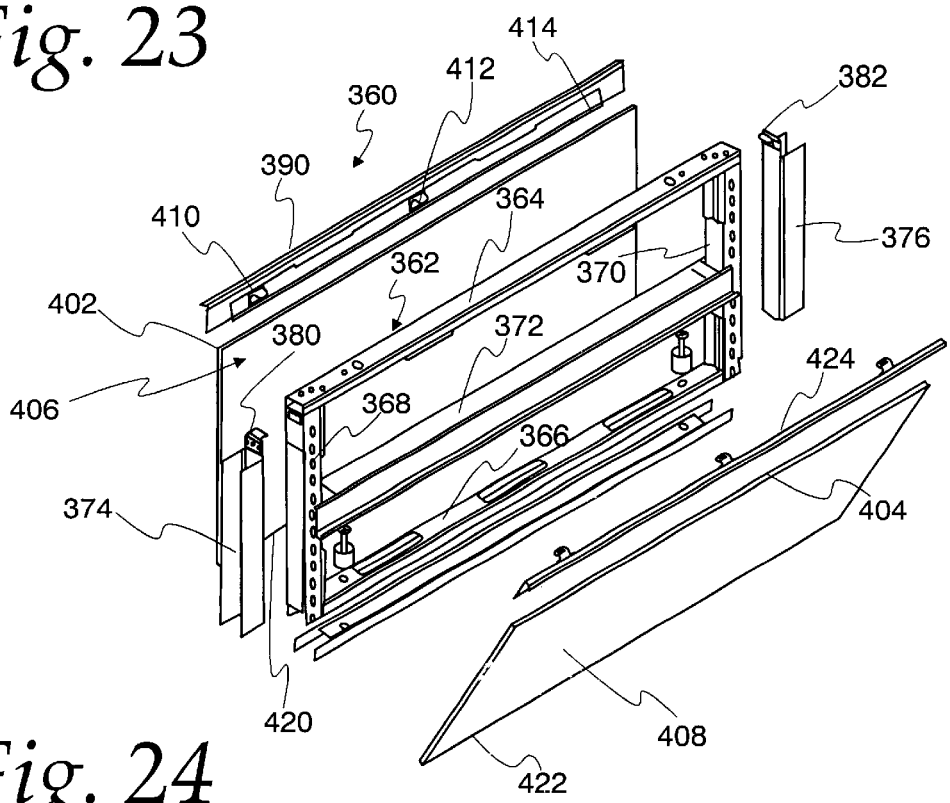
FIG. 23 is an exploded isometric view of yet another wall panel.
Figure 24:
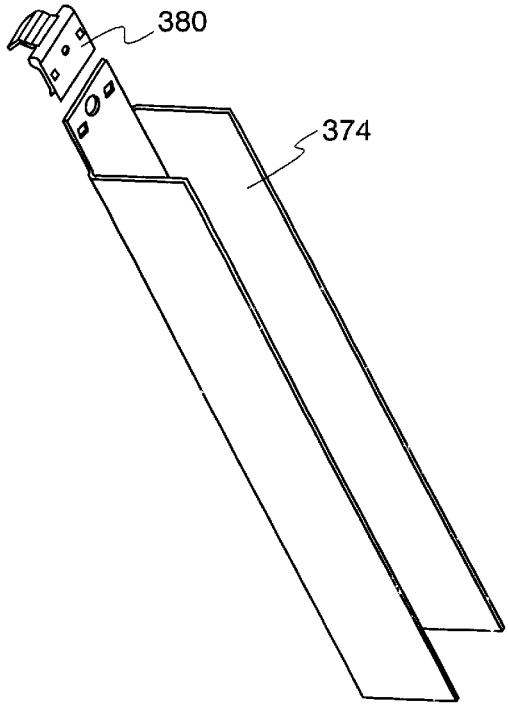
FIG. 24 is an exploded view of a shroud channel assembly.

Referring now to FIG. 23, there is illustrated another embodiment of a glass wall panel 360. As with the previously described embodiments, there is a rectangular metal frame 362 formed of a tubular top frame member 364, a tubular bottom frame member 366 and tubular side frame members 368, 370. A bottom channel fastener 372 constructed like the bottom channel 286 shown in FIGS. 20 and 21 is provided to overlay the bottom frame member 366. Shroud channels 374, 376 similar to the shroud channel 320 described in relation to FIGS. 20 and 22 are also provided. However, as shown in FIGS. 23 and 24, the shroud channels form assemblies with attachment clips 380, 382. These clips are similar to that described in relation to FIGS. 8 and 9 and are attached to the top of the shroud channels for engagement with the top of the rectangular frame.

Figure 8:
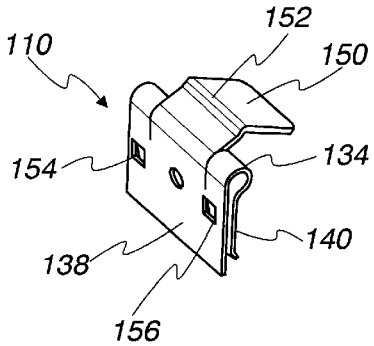
FIG. 8 is a rear isometric view of an attachment clip.
Figure 9:
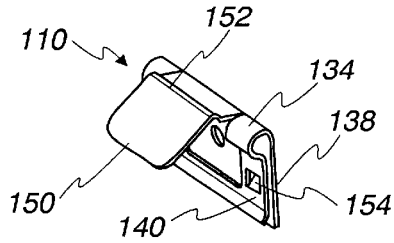
FIG. 9 is a front isometric view of the attachment clip shown in FIG. 8.
Figure 25:
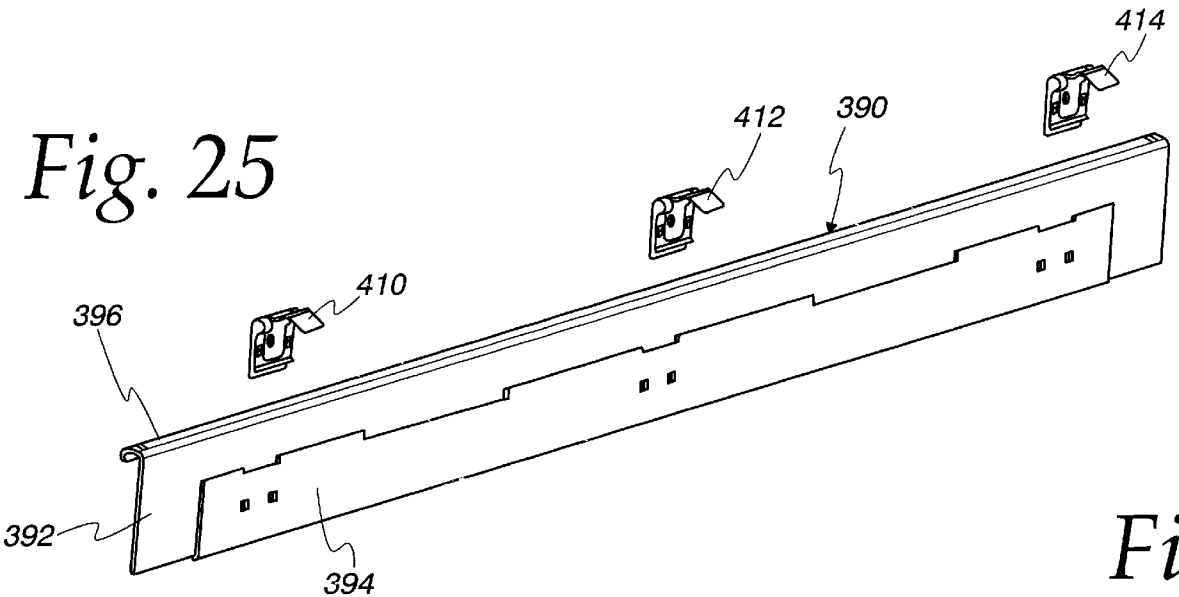
FIG. 25 is an exploded isometric view of a rail assembly.
Figure 26:
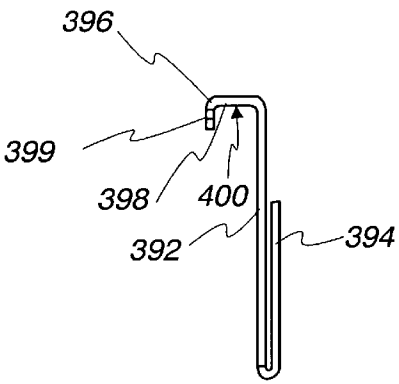
FIG. 26 is an enlarged sectional view of the rail taken along line 26—26 of FIG. 25.

The embodiment shown in FIG. 23 includes a top rail fastener assembly 390, FIGS. 23, 25 and 26, having a rail 391 with a center portion 392 adjacent a clip portion 394, which is bent one hundred eighty degrees relative to the center portion, and a hook portion 396 which is bent at a first arm 398 at ninety degrees relative to the center portion and then a finger 399 bent again at ninety degrees to form a U-shaped channel 400. The U-shaped channel receives upper edges 402, 404 of glass panes 406, 408 and attachment clips 410, 412, 414 like those described in relation to FIGS. 8 and 9 are connected to the clip portion 394 of the rail 391. With the top rail assembly mounted on the glass panes, the lower edges 420, 422 of the glass panes are received by the hook portions of the bottom channel 372 and the rail assembly is pivoted toward the rectangular frame to allow the attachment clips to engage the top frame member. An identical rail assembly 424 is provided for the glass pane 408.

Figure 13:
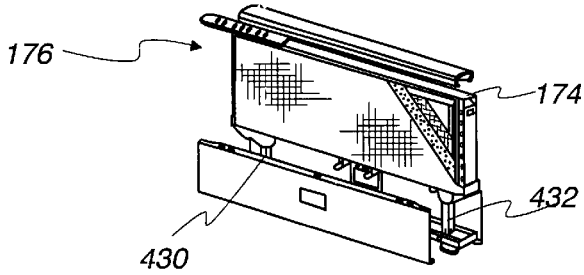
FIG. 13 is a truncated, partially exploded, partially broken away isometric view of a base wall panel.
Figure 27:
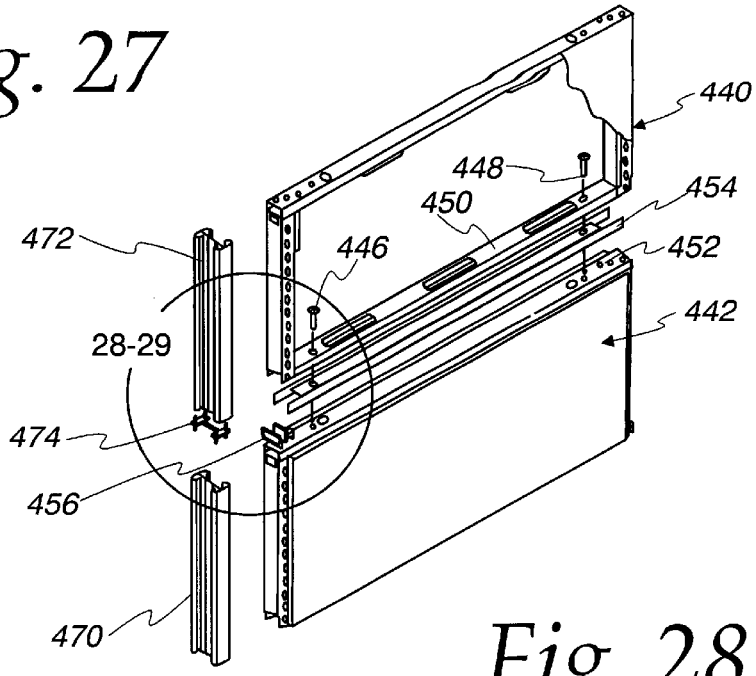
FIG. 27 is an exploded isometric view, partially broken-away, of a stacking panel, base panel and vertical connectors.
Figure 28:
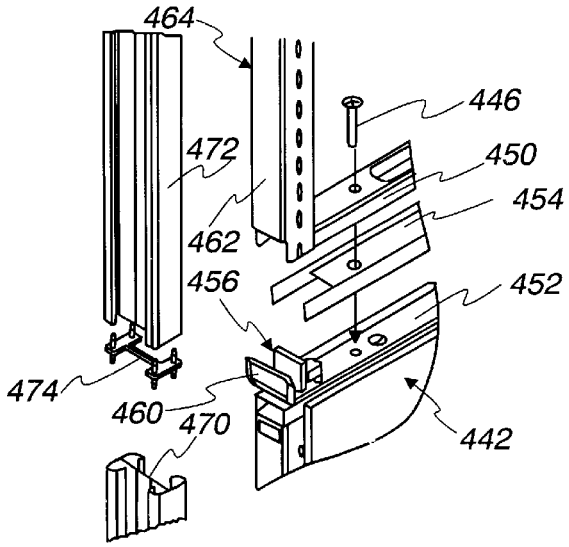
FIG. 28 is an enlarged exploded isometric view taken within the circle 28—28 of FIG. 27.
Figure 29:
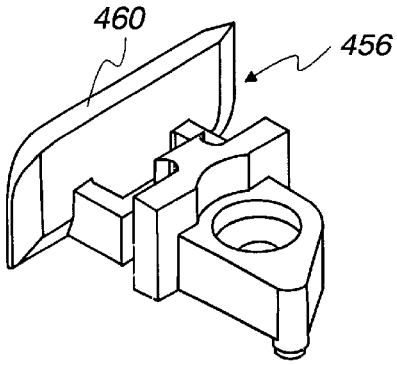
FIG. 29 is an enlarged isometric view of a stacking connector bracket shown in FIGS. 27 and 28.

Should any of the above described embodiments be used as a base wall panel, it is mounted to metal supports 430, 432, FIG. 13, with attached glides for vertical adjustability. This type of structure is well known to those skilled in the art. However, when the wall panels are placed upon another panel where the upper panel 440, FIG. 27, is referred to as the stacking panel and the lower panel 442 is referred to as the base panel or another stacking panel, a decorative top cap 444, FIG. 13, is removed from the lower panel and the stacking panel 440 is attached to the lower panel by the screw fasteners 446, 448 passing through the bottom frame member 450 of the stacking panel 440 and the top frame member 452 of the lower wall panel 442 with a light blocking strip 454 between the two panels. To complete the support of the stacking panel, a connector bracket 456, FIGS. 28 and 29, is mounted to the end of the top frame member 452 of the lower panel 442. An outer wall 460 of the bracket aligns with an outer wall 462 of the side frame member 464.

It is also well known among those skilled in the art that wall panels are attached to vertical connectors 470, FIGS. 27 and 28, allowing multiple wall panels, such as shown in FIG. 1, to be serially connected to create the desired workspace enclosure. Such vertical connectors are shown in FIGS. 27 and 28 including the lower panel connector 470, a stacking panel connector 472 and a mating connector 474.

Figure 30:
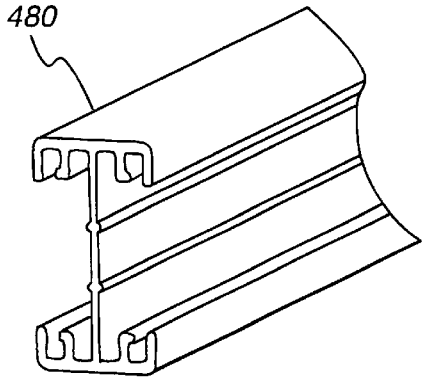
FIG. 30 is a partial isometric view of a vertical connector shown in FIGS. 27 and 28.
Figure 31:
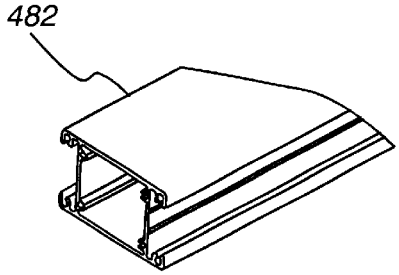
FIG. 31 is a partial isometric view of another vertical connector.
Figure 32:
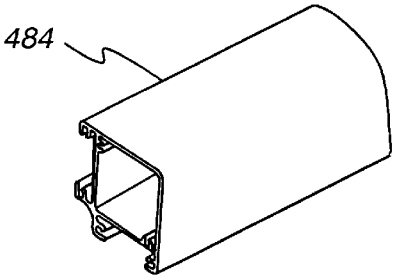
FIG. 32 is a partial isometric view of yet another vertical connector.
Figure 33:
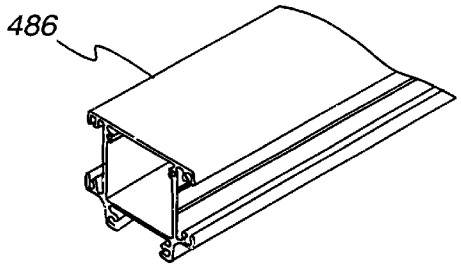
FIG. 33 is a partial isometric view of a fourth vertical connector.
Figure 34:
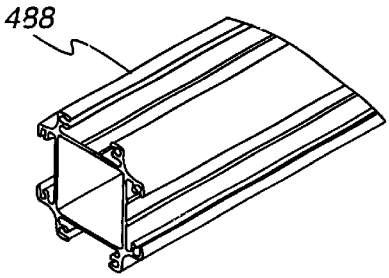
FIG. 34 is a partial isometric view of a fifth vertical connector.
Figure 35:
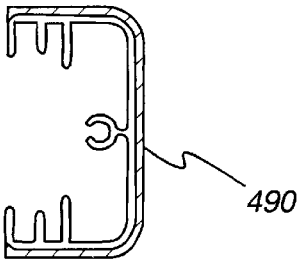
FIG. 35 is an end view of an end vertical connector.
Figure 36:
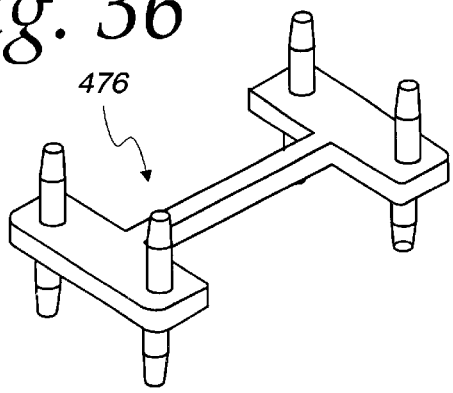
FIG. 36 is an enlarged isometric view of a mating connector shown in FIGS. 27 and 28.

Referring now to FIGS. 30–35, there is shown a number of additional vertical connectors, the use of which depends upon the particular architecture or geometry of the wall panel system being constructed. For example, FIG. 30 illustrates a vertical connector 480 that is used for aligning two wall panels in a straight or linear fashion. The connector 482 shown in FIG. 31 is also used for aligning wall panels linearly although the connector provides greater space between each pair of wall panels. The vertical connector 484 illustrated in FIG. 32 is used when panels are connected at right angle as is the case of the wall panels 22, 24 in FIG. 1. When three wall panels are connected in a "T" configuration, a vertical connector 486, illustrated in FIG. 33, is used. When four wall panels come together at ninety degree intervals, then a vertical connector 488 illustrated in FIG. 34 may be used. When an end is reached, an end connector 490, FIG. 35, is appropriate.

Figure 37:
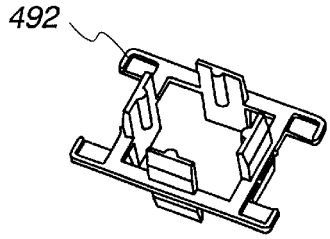
FIG. 37 is an isometric view of another mating connector.
Figure 38:
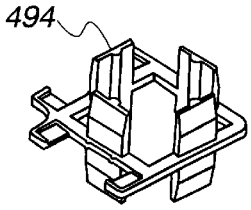
FIG. 38 is an isometric view of still another mating connector.
Figure 39:
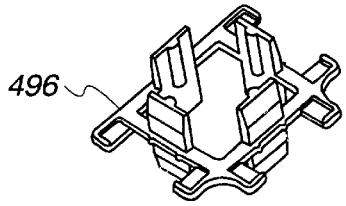
FIG. 39 is an isometric view of yet another mating connector.
Figure 40:
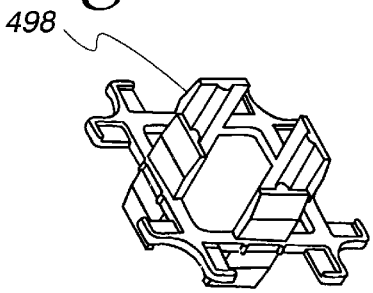
FIG. 40 is an isometric view of a fifth mating connector.
Figure 41:
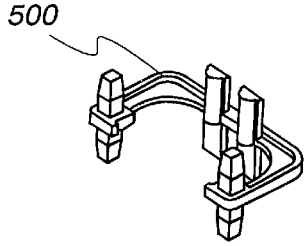
FIG. 41 is an isometric view of a sixth mating connector.

Stacking wall panels also require vertical connectors, although a short version, but otherwise identical in cross section to the connector immediately below. Reference is now made to FIGS. 36–41 illustrating mating connectors whose shape depends upon the cross section of the vertical connectors. For example, in FIG. 36 there is illustrated the mating connector 474 that is also shown in FIGS. 27 and 28, used for connecting vertical connectors, such as the vertical connector 480, FIG. 30. A mating connector 492, FIG. 37, is used with vertical connector 482, FIG. 31. A right angle mating connector 494, FIG. 38, is used with the vertical connector 484, FIG. 32. A "tee" mating connector 496, FIG. 39, is used with the vertical connector 486, FIG. 33. A "cross" mating connector 498, FIG. 40, is used with the vertical connector 488, FIG. 34, and an end mating connector 500, FIG. 41, is used with an end vertical connector 490, FIG. 35.

The above specification describes in detail preferred embodiments of the present invention. Other examples, embodiments, modifications and variations will, under both the literal claim language and the doctrine of equivalents, come within the scope of the invention defined by the appended claims. For example, minor dimensional or shape changes in any or all of the elements of the wall panel system are considered equivalent and will also come within the literal language of the claims. Still other alternatives will also be equivalent as will many new technologies. There is no desire or intention here to limit in any way the application of the doctrine of equivalents nor to limit or restrict the scope of the claims.

What is claimed is:

1. A wall panel apparatus comprising:

a rectangular frame of tubular metal including horizontally disposed top and bottom frame members and two vertically disposed side frame members, wherein said bottom frame member includes at least two fastener receiving openings through said tubular metal;

two tiles connected to said rectangular frame; and fasteners for connecting said tiles to said rectangular frame, wherein each of said tiles is made of metal having a generally flat middle portion, a double bent peripheral portion and a plurality of spaced apart openings, said plurality of spaced apart openings for receiving a plurality of fasteners;

said top and side frame members includes recesses for engaging said fasteners;

said bottom frame member includes a slot for receiving said fasteners;

said fasteners include a plurality of clips;

each clip includes a resilient tab and offset fingers for engaging selective openings of said plurality of spaced apart openings;

at least one of said clips includes an extending tab for being received by said slot in said bottom frame member; and including:

an H-shaped strip abutting said bottom frame member.

2. A wall panel apparatus comprising:

a rectangular frame of tubular metal including horizontally disposed top and bottom frame members and two vertically disposed side frame members, wherein said bottom frame member includes at least two fastener receiving openings through said tubular metal;

two tiles connected to said rectangular frame; and fasteners for connecting said tiles to said rectangular frame; wherein:

each of said tiles includes a plastic frame portion, a first panel adhered to said plastic frame portion and a second fiber glass panel adhered to said first panel;

said fasteners including a plurality of male connector parts connected to each tile and a plurality of female connector parts connected to said rectangular frame for engaging said male connecting parts;

each of said female connector parts has a V-shaped cross section including two extended arms and a base, and each of said arms includes a shoulder; and each of said plurality of male connectors includes a short arm with a shoulder, said shoulder of said male connector part for abutting said shoulder of said female connector part.

3. A wall panel apparatus comprising:

a rectangular frame of tubular metal including horizontally disposed top and bottom frame members and two vertically disposed side frame members, wherein said bottom frame member includes at least two fastener receiving openings through said tubular metal;

two tiles connected to said rectangular frame; and fasteners for connecting said tiles to said rectangular frame, wherein each of said tiles comprises a pane of glass; and including a bottom channel member having a base, two arms and a hook formed on the extended end of each of said two arms, said bottom channel being disposed over said bottom frame member;

a spacer located between said bottom frame member said bottom channel;

two vertical shroud channels being disposed over said two side frame members; and a spacer located between each of said side frame members and a corresponding one of said vertical shroud channels.

4. An apparatus as claimed in claim 3 including:

a top channel having a base, two arms and a hook formed on the extended end of each of said two arms, said top channel being disposed about said top frame member.

5. An apparatus as claimed in claim 4 including:

an H-shaped strip abutting said bottom frame member.

6. An apparatus as claimed in claim 3 including:

two top rails, each top rail engaging a top portion of a respective glass pane; and a plurality of clips attached to each of said top rails for engaging said rectangular frame.

7. A method for assembling a wall panel comprising the steps of:

providing a rectangular metal frame, said rectangular frame including top and bottom frame members and side frame members;

providing two panes of glass;

providing fasteners in the form of top and bottom channels;

providing side shroud channels;

providing bottom spacers;

providing side spacers;

providing top pads;

providing tensioning screws;

placing said bottom spacers on said bottom frame member;

placing said bottom channel on said bottom spacers;

placing a bottom edge of each of said glass panes on said bottom channel;

placing said side spacers on said side frame members;

placing said side shroud channels over said side frame members and said side spacers;

placing said top pads in said top channel;

placing said top channel about said top frame member;

engaging top edges of each of said glass panes with said top channel; and adjusting said tensioning screws.

8. A modular wall panel apparatus comprising:

a rectangular frame having horizontally disposed top and bottom frame members and vertically disposed side frame members;

two opposing tiles mounted to said frame; and fasteners for connecting said tiles to said frame, wherein each of said tiles are formed of steel having a periphery having to bends, one at ninety degrees and the other at one hundred and eighty degrees and including a plurality of grouped openings around said periphery, each group having one slot opening and two rectangularly shaped openings; and said fasteners are each resilient and U-shaped with two legs with an integral extending tab and two offset fingers, one of said legs being received by a slot opening of a tile and said two offset fingers being received by the pair of rectangularly shaped openings of a tile the slot and the pair of rectangularly shaped openings being part of a single group, and said tab being received by said frame.

9. A modular wall panel apparatus comprising:

a rectangular frame having horizontally disposed top and bottom frame members and vertically disposed side frame members;

two opposing tiles mounted to said frame; and fasteners for connecting said tiles to said frame, wherein each of said tiles are formed of a plastic frame, a first panel and a second fiberglass panel; and said fasteners each includes male and female connector parts, each of said female connector parts having a V-shaped cross section including two extending arms and a base and each of said arms having a shoulder, and each of said male connector pats having a short arm with a shoulder, said shoulder of said male connector part for abutting a shoulder of a corresponding female connector part.

10. A modular wall panel apparatus comprising:

a rectangular frame having horizontally disposed top and bottom frame members and vertically disposed side frame members;

two opposing tiles mounted to said frame; and fasteners for connecting said tiles to said frame, wherein each of said tiles are formed of glass; and said fasteners are each a channel member having a base, two arms and a hook formed on the extended end of each of said two arms; and including two shroud channels being disposed over said vertically disposed side frame members;

a first set of spacers located between said bottom and top frame members and respective channel members; and a second set of spacers located between said side frame members and respective shroud channels.

11. The apparatus of claim 10 wherein:

each of said shroud channels includes a group of openings at an end portion thereof, said group having a first round opening and two rectangularly shaped openings; and including a resilient fastener having a U-shape with two legs, an integral extending tab and two offset fingers, said two offset fingers being received by the pair of rectangularly shaped openings of a shroud channel.

12. A modular wall panel apparatus comprising:

a rectangular frame having horizontally disposed top and bottom frame members and vertically disposed side frame members;

two opposing tiles mounted to said frame; and fasteners for connecting said tiles to said frame, wherein each of said tiles are formed of glass; and fasteners for connecting said tiles to said frame, wherein each of said tiles are formed of glass; and said fasteners include a rail having a center portion, an adjacent clip portion bent one hundred eighty degrees relative to the center portion and a hook portion which is bent at a first arm at ninety degrees relative to the center portion and at a finger bent at ninety degrees to form a U-shaped channel, and a resilient clip having a U-shape with two legs, an integral extending tab and two offset fingers, said two legs for being received by the clip portion of the rail and the two offset fingers being received by a pair of rectangularly shaped openings in said clip portion of the rail.

13. A modular wall panel apparatus comprising:

a first rectangular frame having horizontally disposed top and bottom frame members and vertically disposed side frame members;

a first pair of opposing tiles mounted to said first frame;

fasteners for connecting said first pair of tiles to said first frame;

a second rectangular frame having horizontally disposed top and bottom frame members and vertically disposed side frame members;

a second pair of opposing tiles mounted to said second frame;

fasteners for connecting said second pair of tiles to said second frame; and a connector bracket mounted to said top frame member of said first frame and received by said bottom frame member of said second frame, said connector bracket having an outer wall for engaging an outer wall of a respective side frame member of said second frame.

* * * * *